US007083491B2

(12) United States Patent
Tsuji et al.

(10) Patent No.: US 7,083,491 B2
(45) Date of Patent: Aug. 1, 2006

(54) METHOD OF MANUFACTURING PLASMA DISPLAY PANELS AND BAKING PANEL DEVICE USED FOR THE METHOD

(75) Inventors: Hiroyasu Tsuji, Osaka (JP); Makoto Morita, Hyogo (JP); Masanori Suzuki, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 286 days.

(21) Appl. No.: 10/479,252

(22) PCT Filed: Jun. 9, 2003

(86) PCT No.: PCT/JP03/07254

§ 371 (c)(1),
(2), (4) Date: Dec. 1, 2003

(87) PCT Pub. No.: WO03/107379

PCT Pub. Date: Dec. 24, 2003

(65) Prior Publication Data

US 2004/0198130 A1 Oct. 7, 2004

(30) Foreign Application Priority Data

Jun. 12, 2002 (JP) ..... 2002-170886

(51) Int. Cl.
*H01J 9/38* (2006.01)
*H01J 9/46* (2006.01)
*H01Y 21/04* (2006.01)

(52) U.S. Cl. ..... 445/59; 445/66; 445/23

(58) Field of Classification Search ..... 445/24
See application file for complete search history.

(56) References Cited

U.S. PATENT DOCUMENTS 5,526,151 A * 6/1996 Miyazaki et al. ..... 349/139

FOREIGN PATENT DOCUMENTS

| | | |
|---|---|---|
| JP | 1-60337 | 4/1989 |
| JP | 6-185873 | 7/1994 |
| JP | 7-2892 | 1/1995 |
| JP | 9-42854 | 2/1997 |
| JP | 2000-111265 | 4/2000 |
| JP | 2000-268737 | 9/2000 |
| JP | 2001-241849 | 9/2001 |
| JP | 2001-316186 | 11/2001 |
| JP | 2001-349678 | 12/2001 |

* cited by examiner

*Primary Examiner*—Mariceli Santiago
*Assistant Examiner*—Elizabeth Rielley
(74) *Attorney, Agent, or Firm*—Wenderoth, Lind & Ponack, L.L.P.

(57) ABSTRACT

A method of manufacturing plasma display panels includes using a firing device that allows preferable firing of panel components by cleaning each setter. A cleaning section provided in a lower passage of the firing device allows removal and cleaning of abrasion powder generated while setter is transported by rotation of rollers. This reduces attachment or mixing of abrasion powder to a panel component.

20 Claims, 4 Drawing Sheets

METHOD OF MANUFACTURING PLASMA DISPLAY PANELS AND BAKING PANEL DEVICE USED FOR THE METHOD

TECHNICAL FIELD

The present invention relates to methods of manufacturing plasma display panels (PDPs) which are characterized as large-screen, thin, and lightweight display devices, and firing devices employed in their manufacture.

BACKGROUND ART

PDPs are gaining more attention recently as flat display panels since they have more advantageous features than liquid crystal panels, including faster display time, wider viewing angle, ease of manufacturing large screens, and higher display quality realized by self-light emission. PDPs are being used in an expanding range of contexts, including as displays for public places and wide-screen display devices for domestic viewing.

In a PDP, gas discharge generates ultraviolet rays, and these ultraviolet rays excite the phosphors, which then emit visible light for color display. PDP driving systems can be generally classified into AC and DC types. The electric discharge system can be classified into two types: surface discharge and opposed discharge. The AC surface discharge type that has a 3-electrode structure is the mainstream type with respect to higher definition, larger screens, and easier manufacture. The PDP of the AC surface discharge type that has a 3-electrode structure is configured with multiple pairs of display electrodes aligned in parallel on one substrate, address electrodes disposed on the other substrate in such a way as to cross the display electrodes, a barrier rib, and a phosphor layer. Since the phosphor layer can be made relatively thick, this type of PDP is appropriate for color displays using phosphors.

The method of manufacturing PDPs includes the steps of forming panel components such as electrode, dielectric and phosphor one after another mainly using the step of forming a thick film on the surface of the front substrate and rear substrate by repeating printing, drying and firing; and overlaying and sealing the front substrate and rear substrate on which these panel components are formed. In the above steps, a firing device is used for drying and firing.

As for the firing device, a so-called roller-hearth kiln, fit for mass production, is employed. The roller-hearth kiln has its transportation means configured by aligning multiple rollers in the direction of transportation of the substrate. While firing the panel components formed on the front and rear substrates, the substrates are placed on a support substrate called a setter (this state is hereafter called the firing target) during transportation for firing to prevent damage to each substrate by the transportation means.

The quality of panel components greatly affects the display characteristic of PDP images. Accordingly, a firing process and firing device which prevent attachment or mixing of foreign particles to the panel components are demanded.

However, foreign particles are attached or mixed to the fired panel components when a conventional firing device is employed for firing. This causes, for example, variations in the resistance if the panel components are metal-wired, resulting in low yield for PDPs. One of the causes of foreign particles is abrasion powder generated by friction between the setter and roller when transporting the firing target on the rollers. This abrasion powder attaches mainly on the face of the setter contacting the roller. The setter transported in this condition scatters the abrasion powder in the entire firing device. Consequently, defects due to the abrasion powder occurs frequently.

The present invention is designed to solve this disadvantage, and aims to offer a method of manufacturing PDPs and a firing device employed in the manufacture that reduce attachment or mixing of abrasion powder generated by friction between the roller and setter to the panel components.

SUMMARY OF THE INVENTION

To achieve the above object, the method of manufacturing PDPs of the present invention includes the steps of firing a substrate at a predetermined temperature while the substrate on which panel components are formed is placed on a setter and transported by a transportation means configured with multiple rollers; and cleaning the setter.

This method allows reduction of attachment or mixing of abrasion powder generated by friction between the roller and setter to the panel components. Accordingly, the method of manufacturing PDPs and the firing device that allow preferable firing is achievable.

DETAILED DESCRIPTION OF PREFERRED EMBODIMENT(S)

An exemplary embodiment of the present invention is described below with reference to drawings.

Figure 1:
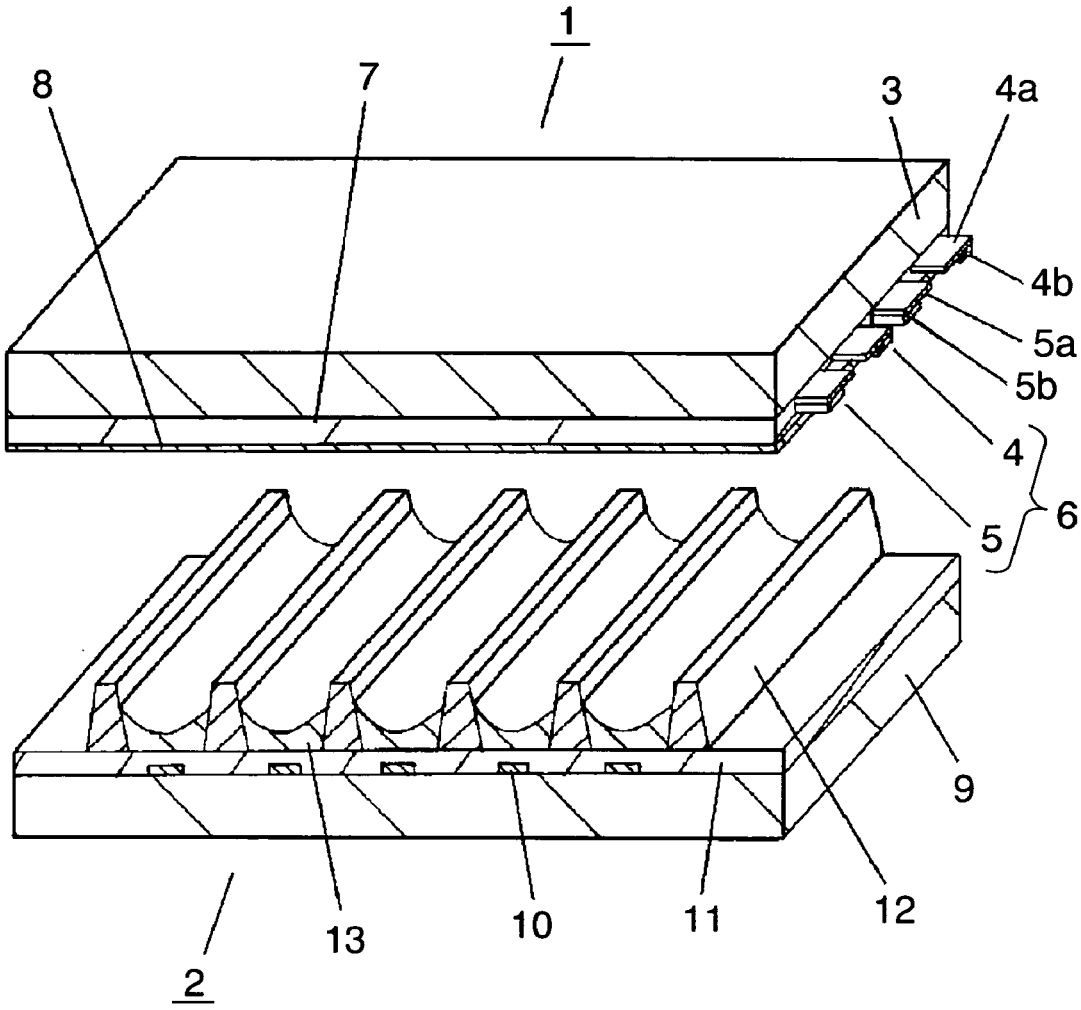
FIG. 1 is a sectional perspective view of a PDP structure.

FIG. 1 shows the structure of a PDP manufactured using a method of manufacturing PDPs of the present invention. The PDP is configured with front substrate 1 and rear substrate 2. Front substrate 1 consists of striped display electrode 6 including a scanning electrode 4 and a sustain electrode 5 formed on a transparent insulating substrate 3, such as a glass substrate made of borosilicate sodium glass using the float process, a dielectric layer 7 covering display electrodes 6, and a protective film 8 made of MgO formed on dielectric layer 7. Scanning electrode 4 and sustain electrode 5 are, for example, configured by transparent electrodes 4*a* and 5*a* made of a transparent conductive material such as ITO and bus electrodes 4*b* and 5*b* made of a material such as Ag and which are electrically coupled to these transparent electrodes 4*a* and 5*a*.

Rear substrate 2 consists of address electrode 10 formed in a direction orthogonal to display electrode 6 on a substrate 9 so as to face substrate 3 of front substrate 1, a dielectric layer 11 covering the address electrode 10, multiple striped barrier ribs 12 parallel to and between address electrodes 10 on dielectric layer 11, and a phosphor layer 13 formed between the barrier ribs 12. For color display, red, green, and blue are in general disposed sequentially in phosphor layers 13.

A sealing member (not illustrated) forms a seal around front substrate 1 and rear substrate 2 such that display electrode 6 and address electrode 10 cross at right angles and such that a small discharge space is secured in between. In the discharge space, discharge gas such as a mixture of neon (Ne) and xenon (Xe) is enclosed. The discharge space is partitioned into multiple blocks by barrier ribs 12. Multiple discharge cells are thus formed between barrier ribs 12, and these discharge cells are unit luminescence regions.

Electric discharge occurs as a result of the voltage periodically applied to address electrode 10 and display electrode 6. The ultraviolet rays generated by this electric discharge irradiate phosphor layer 13, where they are converted to visible light for image display.

Figure 2:
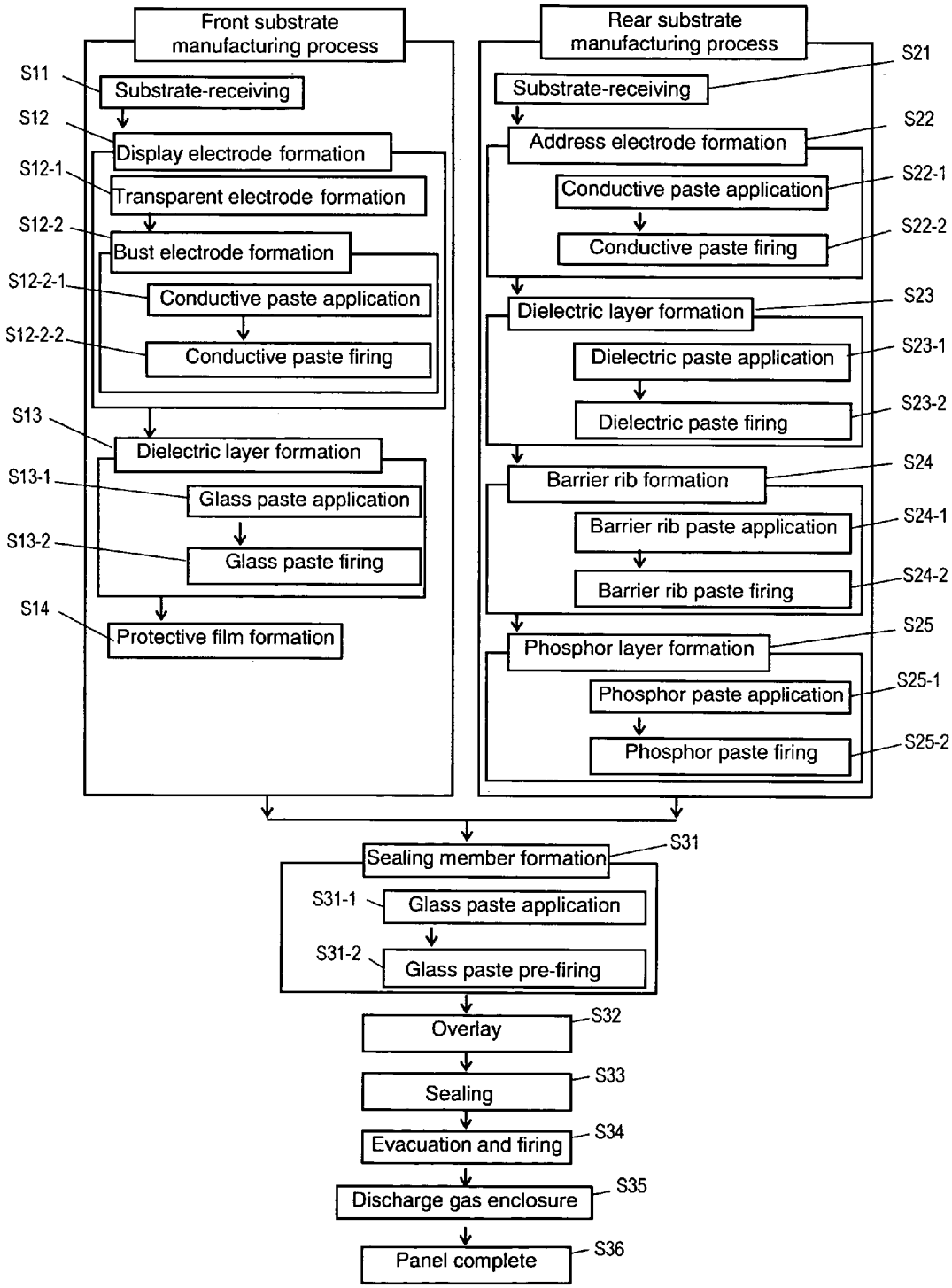
FIG. 2 is a process chart of a method of manufacturing PDPs in accordance with an exemplary embodiment of the present invention.

Next, the method of manufacturing the PDP as configured above is described with reference to FIG. 2, which shows the steps in the method of manufacturing PDPs in the exemplary embodiment of the present invention.

First, the process of manufacturing the front substrate, i.e., front substrate 1, is described. After the substrate-receiving step (S11) to receive substrate 3, the step of forming display electrodes (S12) is executed to form display electrodes 6 on substrate 3. The step of forming the display electrodes (S12) includes the step of forming transparent electrodes (12-1) for forming transparent electrodes 4*a* and 5*a*, and the subsequent step of forming bus electrodes for forming bus electrodes 4*b* and 5*b*. The step of forming bus electrodes (S12-2) includes the step of applying a conductive paste (S12-2-1) for applying a conductive paste such as Ag by screen-printing and the step of firing the conductive paste (S12-2-2) for firing the conductive paste applied. Then, after the step of forming the display electrodes (S12), the step of forming a dielectric layer (S13) is executed to form the dielectric layer 7 to cover the display electrodes. The step of forming the dielectric layer (S13) includes the step of applying a glass paste (S13-1) for applying paste including lead-system glass material [whose composition is, for example, 70 wt % lead oxide (PbO), 15 wt % boron oxide ($B_2O_3$), and 15 wt % silicon oxide ($SiO_2$)] by screen-printing, and the step of firing a glass paste (S13-2) for firing the glass material applied. Then, the step of forming a protective film (S14) is executed to form the protective film 8 such as of magnesium oxide (MgO) by vacuum deposition on the surface of the dielectric layer 7 to complete the manufacture of front substrate 1.

Next, the process of manufacturing the rear substrate, i.e., rear substrate 2, is described. After the step of receiving (S21) for receiving substrate 9, the step of forming address electrodes (S22) is executed to form the address electrodes 10 on substrate 9. This step (S22) includes the step of applying a conductive paste (S22-1) for applying a conductive paste such as of Ag by screen-printing, and a subsequent step of firing the applied conductive paste (S22-2). The step of forming a dielectric layer (S23) is then executed to form the dielectric layer 11 on address electrode 10. This step (S23) includes the step of applying a dielectric paste (S23-1) for applying a dielectric paste containing titanium oxide ($TiO_2$) particles and dielectric glass particles typically by screen-printing, and a subsequent step of firing the applied dielectric paste (S23-2). Then, the step of forming barrier ribs (S24) for forming the barrier ribs 12 on the dielectric layer 11 between the address electrodes 10 is executed. This step (S24) includes the step of applying a barrier paste (S24-1) for applying a barrier paste containing glass particles typically by printing and a subsequent step of firing the barrier paste (S24-2) for firing the applied barrier paste. The step of forming a phosphor layer (S25) for forming the phosphor layer 13 between barrier ribs is then executed. This step (S25) includes the step of applying a phosphor paste (S25-1) for making a color phosphor paste of red, green, and blue, and applying the phosphor paste of these colors between barrier ribs 12, and the subsequent step of firing the applied phosphor paste (S25-2). Rear substrate 2 is completed through these steps.

Next, the step of sealing front substrate 1 and rear substrate 2 manufactured as above and the step of evacuating and enclosing discharge gas are described.

A step of forming a sealing member (S31) for forming a sealing member made of glass frit on one or both of front substrate 1 and rear substrate 2 is executed. This step (S31) includes the step of applying a glass paste for sealing (S31-1) and the step of pre-firing the glass paste (S31-2) for tentatively firing the applied glass paste to remove the resin constituent in the glass paste applied. Then, the overlaying step (S32) is executed to overlay the two substrates such that display electrodes 6 on front substrate 1 and address electrodes 10 on rear substrate 2 cross at right angles. The sealing step (S33) is then executed to soften the sealing member by heating both substrates overlaid for sealing. After the evacuating and firing step (S34) is executed to fire the panel while evacuating a small discharge space created between the sealed substrates, the step of enclosing a discharge gas (S35) is executed to enclose a discharge gas under a predetermined pressure so as to complete the PDP (S36).

In the manufacture of the PDP, as described above, a firing process is often applied when forming panel components such as bus electrodes 4*b* and 5*b*, dielectric layer 7, address electrode 10, dielectric layer 11, barrier rib 12, phosphor layer 13, and a sealing member (not illustrated). A firing device employed in these firing processes is described below.

Figure 3:
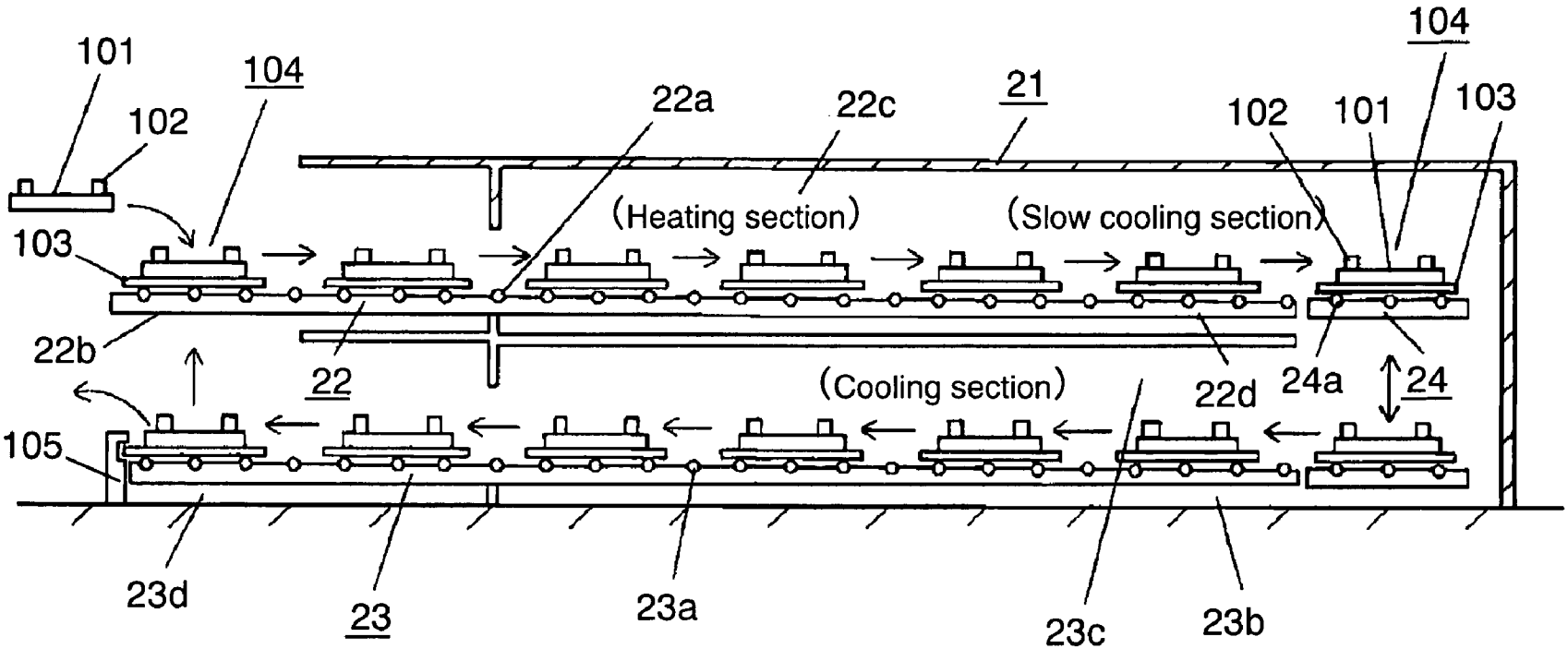
FIG. 3 is a sectional view of a structure of a firing device for PDPs in accordance with the exemplary embodiment of the present invention.

FIG. 3 is a sectional view of the firing device used in the method of manufacturing PDPs in the exemplary embodiment of the present invention. Firing device 21 includes outward transportation mechanism 22 in which multiple rollers 22*a* are aligned in the transporting direction, return transportation mechanism 23 in which multiple rollers 23*a* are aligned in the transporting direction, and elevating mechanism 24 in which multiple rollers 24*a* are aligned in the transporting direction and also configured so as to enable rollers 24*a* to be moved (elevated and lowered) between outward transportation mechanism 22 and return transportation mechanism 23.

Substrate 101, i.e., front substrate 1 or rear substrate 2, of the PDP on which panel components 102 such as bus electrodes 4*b* and 5*b*, dielectric layer 7, address electrode 10, dielectric layer 11, barrier rib 12, phosphor layer 13, or sealing member (not illustrated) are formed is placed on setter 103 which is a support substrate, and transported by outward transportation mechanism 22. Setter 103 is provided so as to prevent damage to substrate 101. A structure in which substrate 101 is placed on setter 103 is hereafter called firing target 104.

In the above configuration, a characteristic of the exemplary embodiment is that a cleaning mechanism 105 for cleaning setter 103 is provided. As shown in FIG. 3, abrasion powder is generated by friction between rollers 22*a*, 23*a* and 24*a* and setter 103 while setter 103 is transported by rotation of rollers 22*a*, 23*a*, and 24*a*. This generated abrasion powder attaches to the contacting face (rear face hereafter) of setter 103. In the exemplary embodiment of the present invention, the cleaning mechanism 105 is provided, for example, inside lower passage 23*c* for cleaning the rear face of setter 103.

Figure 4A:
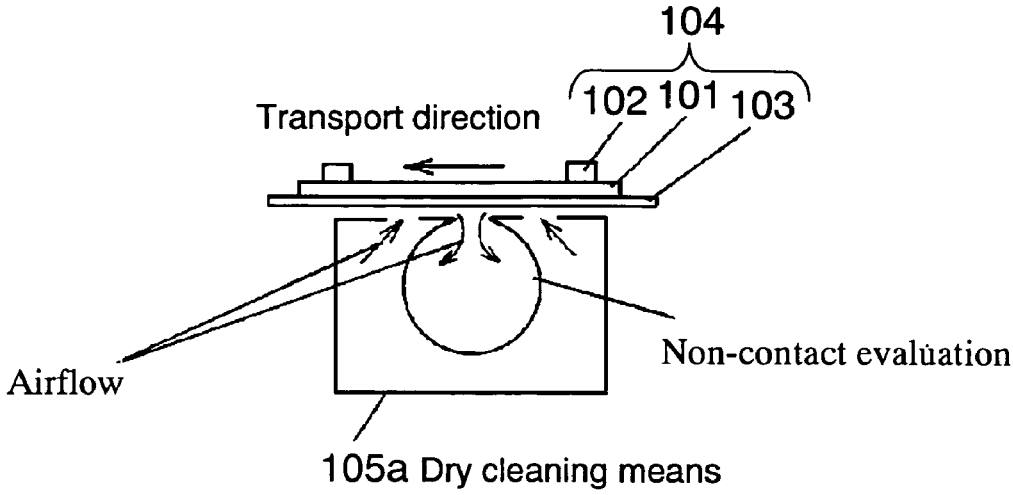
FIG. 4 is a sectional view of a structure of a cleaning means in the firing device for PDPs in accordance with the exemplary embodiment of the present invention.
Figure 4B:
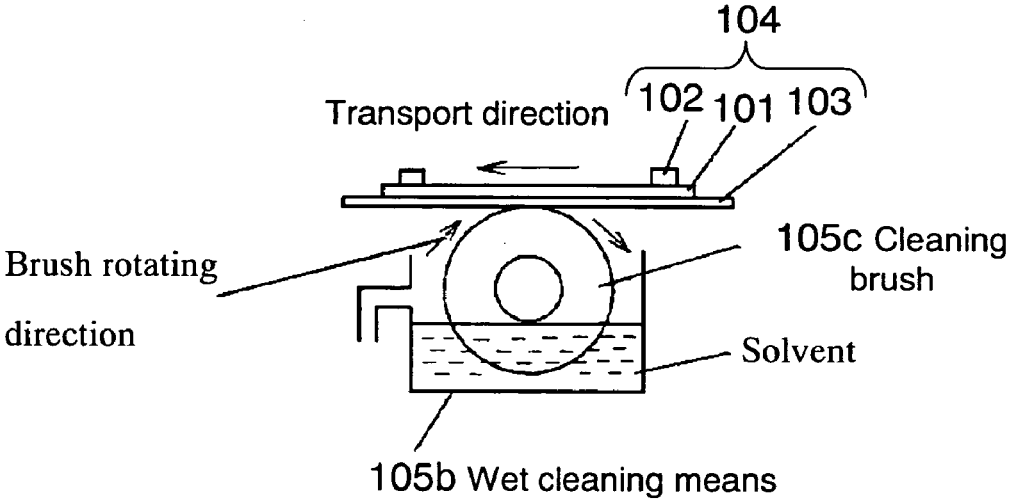

FIG. 4 shows a sectional view of the structure of the cleaning mechanism in the firing device for PDPs in the exemplary embodiment of the present invention. Examples of the cleaning mechanism 105 are dry cleaning mechanism 105*a* shown in FIG. 4A and wet cleaning mechanism 105*b* shown in FIG. 4B.

The dry cleaning mechanism 105*a* shown in FIG. 4A cleans off foreign particles attached to the rear face of setter 103 without contacting setter 103 by lifting away foreign particles by means of an air current generated by suction. Since this is a cleaning method that attracts foreign particles, rather than blowing them off by air blast, setter 103 can be cleaned effectively without any detrimental effects on the ambient atmosphere, such as causing foreign particles to scatter or float in midair.

Moreover, for further effectively removing foreign particles on the rear face of setter 103, the airflow on the rear face of setter 103 is preferably applied in the direction shown by the arrow in FIG. 4A, i.e., along the planar direction of the rear face of setter 103 by suction.

The wet cleaning mechanism 105*b* shown in FIG. 4B cleans the rear face of setter 103 using an organic or inorganic solvent. FIG. 4B shows cleaning of the rear face of setter 103 by rotation of cleaning brush 105*c*. Although an example of using cleaning brush 105*c* is shown in FIG. 4B, a structure that blows solvent onto the rear face of setter 103 without using cleaning brush 105*c* is also feasible.

In wet cleaning, cleaning is insufficient if the temperature T1 (° C.) of setter 103 is higher than the boiling point T2 (° C.) of the solvent, because the solvent will evaporate instantaneously. On the other hand, if the temperature T1 is too low, slow drying of the solvent has a detrimental effect, due in some cases to moisture. Accordingly, the relationship between the temperature T1 (° C.) of setter 103 and the boiling point T2 (° C.) of the solvent is preferably set to a range where the solvent does not boil and evaporate but instead dries and evaporates easily. For example, the temperature relation in which setter 103 dries in about 5 minutes after cleaning is preferable. The experiment suggests that this kind of temperature relation is achieved specifically when temperature T1 (° C.) of setter 103 and boiling point T2 (° C.) of the solvent satisfy the following conditions: $0.9 \times T2 \leqq T1 < T2$. Cleaning under these temperature conditions enables natural drying of the solvent after cleaning, eliminating the need for a drying process and device for setter 103. To satisfy the above temperature conditions, wet cleaning mechanism 105*b* can be provided in any area of the firing device where setter 103 reaches the temperature required.

The firing process employing firing device 21 provided with the cleaning mechanism for setter 103 is described next with reference to FIG. 3. First, firing target 104 is placed on transport start portion 22*b* of outward transportation mechanism 22. Outward transportation mechanism 22 guides firing target 104 to upper passage 22*c* of firing device 21, and a heating device such as a heater (not illustrated) provided inside upper passage 22*c* heats firing target 104 to a predetermined firing temperature in the heating section for firing, while the firing target continues to be transported by outward transportation mechanism 22. Then, in a slow-cooling section, firing target 104 is cooled while being transported toward distal end 22*d* of outward transportation mechanism 22. Firing target 104 is further transported beyond transport distal end 22*d* of outward transportation mechanism 22, and reaches elevating mechanism 24. Firing target 104 reaching elevating mechanism 24 is lowered to the level connected to return transportation mechanism 23 by elevating mechanism 24, and transferred to transport start portion 23*b* of return transportation mechanism 23 by being transported in the reverse direction to the transportation direction of outward transportation mechanism 22. Then, return transportation mechanism 23 transports firing target 104 in lower passage 23*c*, i.e., the cooling section, to cool firing target 104 to a normal temperature. Cleaning mechanism 105 is installed inside lower passage 23*c*.

Since cleaning mechanism 105 cleans the face of setter 103 contacting rollers 22*a*, 23*a*, and 24*a*, foreign particles such as abrasion powder that is generated and becomes attached to setter 104 by contact of setter 103 with rollers 22*a*, 23*a*, and 24*a* during transportation are removed. When firing target 104 reaches transport end portion 23*d* of return transportation mechanism 23, fired substrate 101 is removed from setter 103. Empty setter 103 moves to transport start portion 22*b* of outward transportation mechanism 22 in the upper stage again, and the next substrate 101 is placed and guided into upper passage 22*c* for firing.

Here, firing device 21 employed in the method of manufacturing PDPs in the exemplary embodiment as described above allows elimination of foreign particles such as abrasion powder generated by contact of rollers 22*a*, 23*a*, and 24*a* and setter 103 and which become attached to the rear face of setter 103 during transportation. Accordingly, the risk of foreign particles attached to setter 103 being scattered over firing device 21 is eliminated when setter 103 is used for firing the next substrate. Attachment or mixing of foreign particles with panel components 102 is thus prevented. This makes the quality of the panel components uniform, and allows the manufacture of PDPs at high yield.

In the exemplary embodiment, cleaning mechanism 105*a* or 105*b* is installed inside lower passage 23*c* which is return transportation mechanism 23 of firing device 21. This prevents foreign particles from becoming suspended in the air in upper passage 22*c* where substrates before panel components are fired and solidified are transported, enabling the manufacture of even higher quality PDPs.

The exemplary embodiment describes the case of providing one cleaning mechanism. However, two or more dry cleaning or wet cleaning mechanism can be provided in different parts of the process. In particular, if a wet cleaning mechanism is provided at an upstream location of the transportation and a dry cleaning mechanism is provided in at a downstream location, the temperature can be more effectively controlled relative to the boiling point of the solvent.

INDUSTRIAL APPLICABILITY

As described above, the present invention reduces attachment or mixing of abrasion powder generated by friction between the roller and setter to the panel components. This achieves the method of manufacturing PDPs and the firing device used in the manufacture that enables preferable firing of panel components.

The invention claimed is:

1. A method of manufacturing a plasma display panel, said method comprising:

firing a panel component at a predetermined temperature while transporting the panel component using a transportation mechanism including a plurality of rollers, the panel component being formed on a substrate, and the substrate being supported on a setter having a surface contacting the rollers; and cleaning the surface contacting the rollers.

2. The method of claim 1, wherein said firing is conducted in a firing device, the setter being located inside the firing device, said cleaning of the surface of the setter comprising employing a wet cleaning mechanism using a solvent for cleaning, and said cleaning being performed at a location whereat a temperature of the setter is lower than a boiling point temperature of the solvent.

3. The method of claim 2, wherein a temperature T1 in ° C. of the setter and the boiling point temperature of the solvent T2 in ° C. have a relation $0.9T2 \leqq T1 < T2$ during said cleaning.

4. The method of claim 1, wherein said cleaning comprises employing a dry cleaning mechanism emitting an air current toward a rear side of the setter and sucking the emitted air current.

5. The method of claim 4, wherein the dry cleaning mechanism emits the air current toward the rear side of the setter so that the air current flows along the surface of the setter due to suction of the air current.

6. The method of claim 1, wherein said cleaning comprises cleaning only the surface contacting the rollers.

7. A method of manufacturing a plasma display panel, said method comprising:

outwardly transporting a panel component using an outward transportation mechanism including a plurality of rollers while firing the panel component at a predetermined temperature, the panel component being formed on a substrate, and the substrate being supported on a setter having a surface contacting the rollers;

return transporting the fired panel component formed on the substrate using a return transportation mechanism including a plurality of rollers while the substrate is supported on the setter having the surface contacting the rollers; and during said return transporting, cleaning the surface contacting the rollers.

8. The method of claim 7, wherein said outwardly transporting and said return transporting are conducted in a firing device, the setter being located inside the firing device, said cleaning of the surface of the setter comprising employing a wet cleaning mechanism using a solvent for cleaning, and said cleaning being performed at a location whereat a temperature of the setter is lower than a boiling point temperature of the solvent.

9. The method of claim 7, wherein said cleaning comprises employing a dry cleaning mechanism emitting an air current toward a rear side of the setter and sucking the emitted air current.

10. The method of claim 7, wherein said cleaning comprises cleaning only the surface contacting the rollers.

11. A firing device for manufacturing a plasma display panel, said firing device comprising:

a transportation mechanism including a plurality of rollers aligned along a transport direction of a substrate having a panel component formed thereon;

a heating device for heating and firing the substrate while the substrate supported on a setter is transported by said transportation mechanism such that a surface of said setter contacts said rollers; and a cleaning mechanism for cleaning said surface contacting said rollers.

12. The firing device of claim 11, wherein said setter is arranged so as to be heated by said heating device, said cleaning mechanism is a wet cleaning mechanism employing a solvent for cleaning, said wet cleaning mechanism being located such that a temperature of said setter is lower than a boiling point temperature of said solvent during operation of said wet cleaning mechanism.

13. The firing device of claim 12, wherein said wet cleaning mechanism is located such that a temperature T1 in ° C. of said setter and the boiling point temperature of said solvent T2 in ° C. have a relation $0.9T2 \leqq T1 < T2$ during operation of said wet cleaning mechanism.

14. The firing device of claim 11, wherein said cleaning mechanism is a dry cleaning mechanism operable to emit an air current toward a rear side of said setter and to suck the emitted air current.

15. The firing device of claim 14, wherein said dry cleaning mechanism is operable to emit the air current toward said rear side of said setter so that the air current flows along said surface of said setter due to suction of the air current.

16. The firing device of claim 11, wherein said cleaning mechanism is arranged and operable to clean only said surface contacting said rollers.

17. A firing device for manufacturing a plasma display panel, said firing device comprising:

an outward transportation mechanism including a plurality of rollers aligned along a transport direction of a substrate having a panel component formed thereon;

a return transportation mechanism including a plurality of rollers aligned along the transport direction of the substrate;

a heating device for heating and firing the substrate while said substrate placed on a setter is transported by said outward transportation mechanism such that a surface of said setter contacts said rollers of said outward transportation mechanism; and a cleaning mechanism for cleaning said surface contacting said rollers, said cleaning mechanism being located at said return transportation mechanism.

18. The firing device of claim 17, wherein said setter is arranged so as to be heated by said heating device, said cleaning mechanism is a wet cleaning mechanism employing a solvent for cleaning, said wet cleaning mechanism being located such that a temperature of said setter is lower than a boiling point temperature of said solvent during operation of said wet cleaning mechanism.

19. The firing device of claim 17, wherein said cleaning mechanism is a dry cleaning mechanism operable to emit an air current toward a rear side of said setter and to suck the emitted air current.

20. The firing device of claim 17, wherein said cleaning mechanism is arranged and operable to clean only said surface contacting said rollers.

* * * * *

UNITED STATES PATENT AND TRADEMARK OFFICE

CERTIFICATE OF CORRECTION

PATENT NO. : 7,083,491 B2
APPLICATION NO. : 10/479252
DATED : August 1, 2006
INVENTOR(S) : Hiroyasu Tsuji et al.

It is certified that error appears in the above-identified patent and that said Letters Patent is hereby corrected as shown below:

IN THE CLAIMS

In column 7, line 9, please replace “T1 in ° C. of” with --T1 in ° C of--.

In column 7, line 10, please replace “T2 in ° C. have” with --T2 in ° C have--.

In column 8, line 12, please replace “T1 in ° C. of” with --T1 in ° C of--.

In column 8, line 13, please replace “T2 in ° C. have” with --T2 in ° C have--.

Signed and Sealed this

Twenty-sixth Day of December, 2006

JON W. DUDAS
*Director of the United States Patent and Trademark Office*